US006024218A

United States Patent [19]

Knoblauch

[11] Patent Number: 6,024,218

[45] **Date of Patent: *Feb. 15, 2000**

[54] BOX FOR STORING AND DISPLAYING DRILL BITS AND THE LIKE

[75] Inventor: Georg Knoblauch, Giengen, Germany

[73] Assignee: Firma Georg Knoblauch, Giengen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,437

[22] Filed: Feb. 25, 1997

[30] Foreign Application Priority Data

Mar. 27, 1996 [DE] Germany ..... 196 12 149

[51] Int. Cl.[7] ..... B65D 85/28

[52] U.S. Cl. ..... 206/379; 206/372; 211/69

[58] Field of Search ..... 206/379, 372, 206/737, 751, 752, 759, 762, 763, 45.23, 373, 472, 473, 474; 211/69, 70.1; 220/338, 342

[56] References Cited

U.S. PATENT DOCUMENTS 2,775,342 12/1956 Smith ..... 206/17
4,006,821 2/1977 Sautter ..... 206/379
4,660,719 4/1987 Peterson et al. ..... 206/379
4,955,478 9/1990 Rau et al. ..... 206/379

*Primary Examiner*—Paul T. Sewell
*Assistant Examiner*—Nuan T. Lam
*Attorney, Agent, or Firm*—Herbert Dubno; Andrew Wilford

[57] ABSTRACT

A storage/display box for elongated objects has a generally parallepipedal and hollow base having a pair of parallel and spaced side walls and a normally horizontal floor extending between the pair of side walls, a cover pivotal on the base between a closed position closely engaged over the base and closing same and an open position standing upward therefrom, and a holder fittable in the box, adapted to hold at least one of the objects, and having a pair of side walls juxtaposed with the respective side walls of the base. A pivot pin is seated in one of the pairs of side walls for pivoting of the holder between a down end position wholly received in the base and an up end position projecting upward therefrom and through an intermediate position between the down and up positions. A guide formed in the other pair of side walls extends transversely of the floor and receives the pin for movement of the pin relative to the one pair of side walls limitedly transversely relative to the floor. A cam on the holder engageable with the floor displaces the holder away from the floor on movement from either of the end positions into the intermediate position and also displaces the holder toward the floor on movement from the intermediate position into either of the end positions.

12 Claims, 6 Drawing Sheets

BOX FOR STORING AND DISPLAYING DRILL BITS AND THE LIKE

FIELD OF THE INVENTION

The present invention relates to a box for storing elongated objects. More particularly this invention concerns a box for storing and displaying drill bits or the like.

BACKGROUND OF THE INVENTION

A standard box for storing and displaying drill bits and the like has a generally parallepipedal and hollow base having a pair of parallel and spaced side walls and a normally horizontal floor extending between the pair of side walls, a cover pivotal on the base between a closed position closely engaged over the base and closing same and an open position standing upward therefrom and a holder fittable in the box, adapted to hold at least one of the objects, and having a pair of side walls juxtaposed with the respective side walls of the base. The holder can pivot in the base between a down end position wholly received in the base and an up end position projecting upward therefrom and through an intermediate position between the down and up positions.

Normally when fully open, the holder or insert is tipped back somewhat so that the box is fairly stable in this position. If, however, the holder is nudged to or past a perfectly vertical position, it closes all by itself. Although it has been suggested to provide some element that resists easy pivoting of the holder in the base, such an element has the disadvantage that it makes opening and closing the box harder, and also that it is not effective when the holder is loaded with heavy objects such as large-diameter drill bits.

OBJECTS OF THE INVENTION

It is therefore an object of the present invention to provide an improved display/storage box for elongated objects like drill bits.

Another object is the provision of such an improved display/storage box for elongated objects like drill bits which overcomes the above-given disadvantages, that is which sits stably when open and that resists inadvertent closing.

SUMMARY OF THE INVENTION

A storage/display box for elongated objects has according to the invention a generally parallepipedal and hollow base having a pair of parallel and spaced side walls and a normally horizontal floor extending between the pair of side walls, a cover pivotal on the base between a closed position closely engaged over the base and closing same and an open position standing upward therefrom, and a holder fittable in the box, adapted to hold at least one of the objects, and having a pair of side walls juxtaposed with the respective side walls of the base. A pivot pin is seated in one of the pairs of side walls for pivoting of the holder between a down end position wholly received in the base and an up end position projecting upward therefrom and through an intermediate position between the down and up positions. A guide formed in the other pair of side walls extends transversely of the floor and receives the pin for movement of the pin relative to the one pair of side walls limitedly transversely relative to the floor. A cam on the holder engageable with the floor displaces the holder away from the floor on movement from either of the end positions into the intermediate position and also displaces the holder toward the floor on movement from the intermediate position into either of the end positions.

Thus with this system the actual weight of the holder and its contents is used to retain it in the end positions. Thus when the holder is filled with heavy objects it will be retained with more force than when it is empty. At the same time the system will not be stable at all in the intermediate position, but from it will naturally seek to move into the closest end position.

According to the invention the guide is formed in the side walls of the base or in the side walls of the holder. Normally the guide is a pair of elongated slots which may extend generally perpendicular to the floor, at an acute angle to the floor, or even be arcuate. The intermediate position is midway between the end positions.

In the open position in accordance with the invention with the floor horizontal the holder cam engages the floor and supports the holder on the floor. The holder can have an end formed with at least one foot defining a plane extending transversely to the guide. In another arrangement the holder includes a U-shaped holder plate traversed by the pin and having an edge turned toward the floor and at least one insert pivoted on the holder plate and having an end constituting the cam and projecting in the intermediate position past the edge. The U-shaped plate has a pair of legs each formed with a slot constituting the guide.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
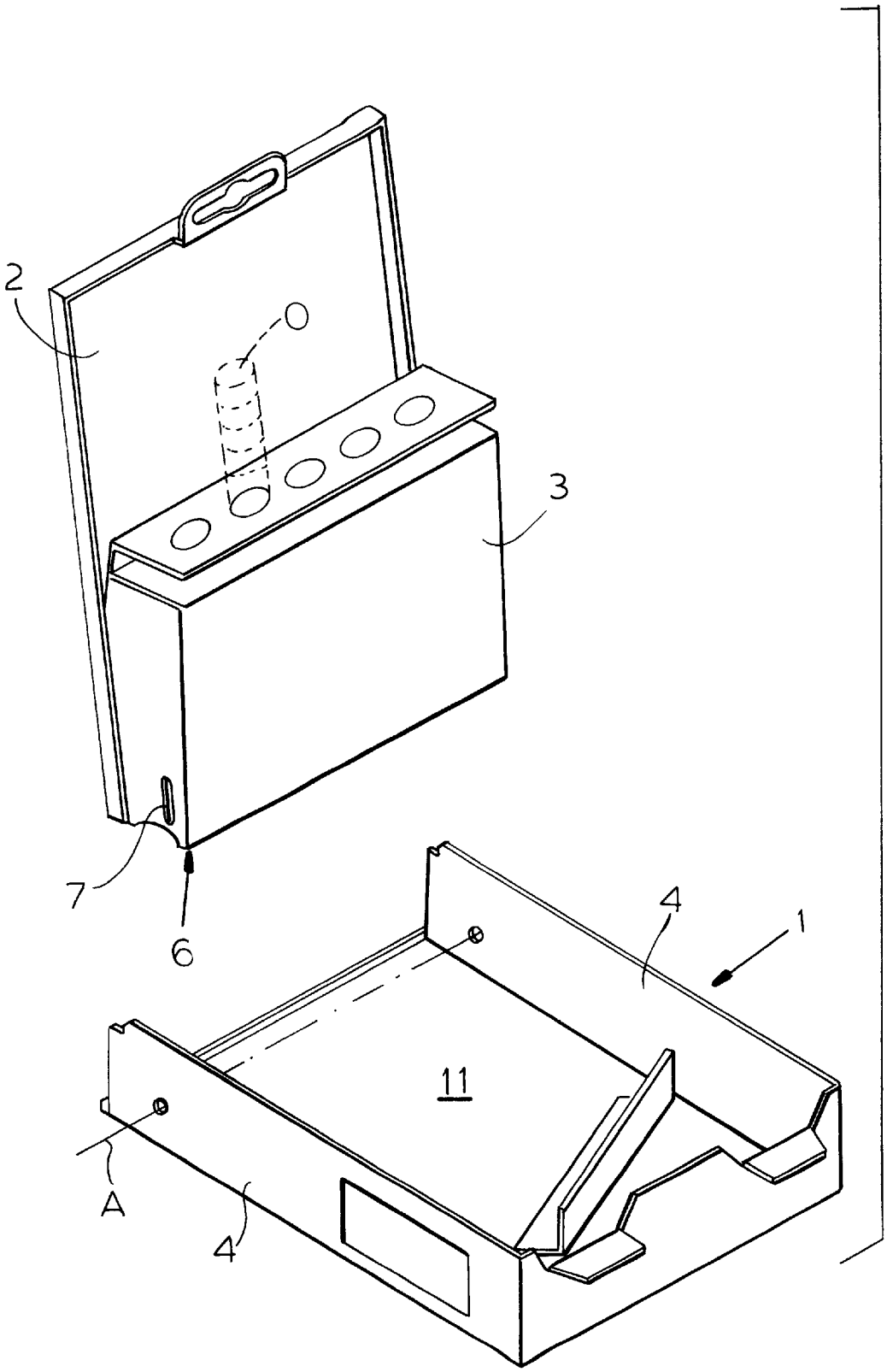
FIGS. 1 and 2 are exploded perspective views of first and second embodiments of the box according to the invention.

As seen in FIGS. 1 through 5 a drill-bit storage and display box has a tray-like parallepipedal base 1 having a pair of parallel side walls 4 and a planar and normally horizontal floor 11. A cover 2 is engageable down over the open top of the base 1 and here is attached to a holder 3 formed with seats adapted to hold respective elongated objects O, here drill bits. A pivot pin 5 defining a normally horizontal axis A extends through the holder 3 and has ends seated in the side walls 4 for pivoting of the holder 3 and cover 2 through somewhat more than 90° from the open position of FIGS. 1 through 4 to the closed position of FIG. 5. The parts 1, 2, and 3 are all stamped out of sheet metal.

The lower edge of the holder 3 adjacent the shaft 5 is formed as a cam 6 that rids on the upper surface of the floor 11. It is shaped relative to the axis A such that as the holder 3 is pivoted about the axis A from the closed (FIG. 5) to the open position (FIGS. 1 through 4) the holder 3 is, in an intermediate position, cammed away from the floor 11. In other words, as the cover 2 and holder 3 are lifted at first the cam 6 pushes the entire cover 2 and holder 3 upward away from the floor 11, then as the open position is reached these parts settle back down somewhat to sit with the cam 6 on the floor 11. On closing the same thing happens in the middle of the travel. Thus the holder 3 holds by its own weight in the open and closed positions but is not stable and will not hold in the intermediate cammed-out position. Thus the box will not be easy to accidentally knock closed, in fact if the objects O being stored are fairly heavy it will be even more unlikely that a light jar would close it.

Figure 4:
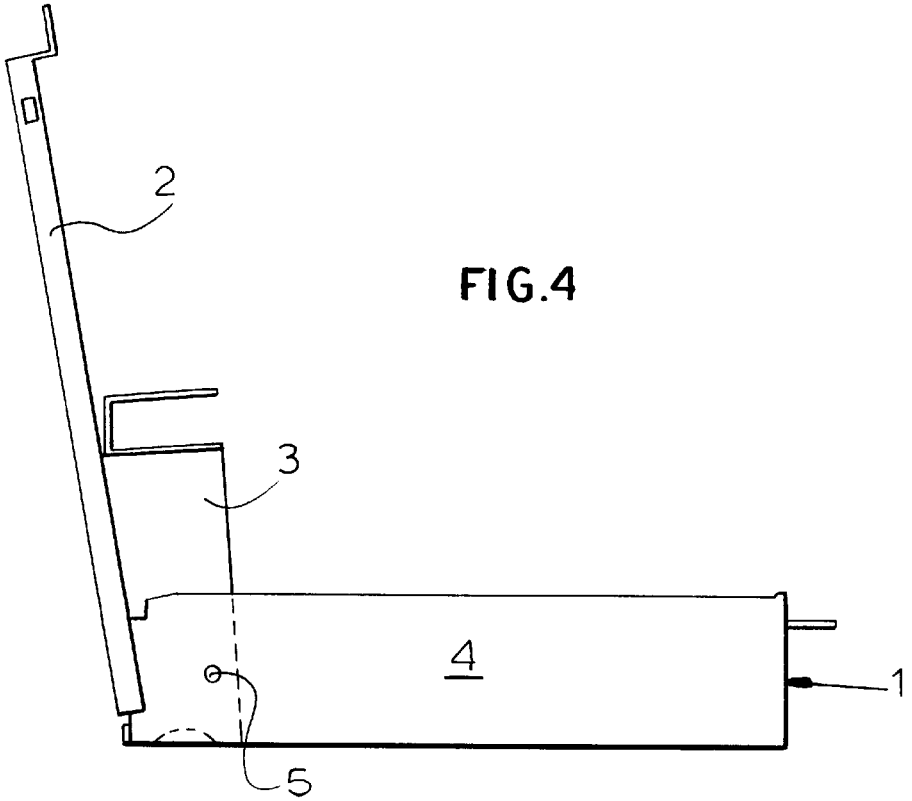

This effect is achieved in the embodiment of FIGS. 1 and 4 by forming in the holder 3 a pair of slots 7 generally perpendicular to the floor 11, the shaft 5 passing through these slots 7 and being seated more or less immovably in the walls 4 of the base 1. The cam 6 is formed at each end of the holder 3 by a pair of feet lying on a plane that sits flatly on the floor 11 and that extends at a slightly acute angle to the elongated slots 7. One of the feet of each pair lies to one side of another plane perpendicular to the foot plane and bisecting the slots 7 and the other foot lies to the other side of this bisecting plane.

Figure 2:
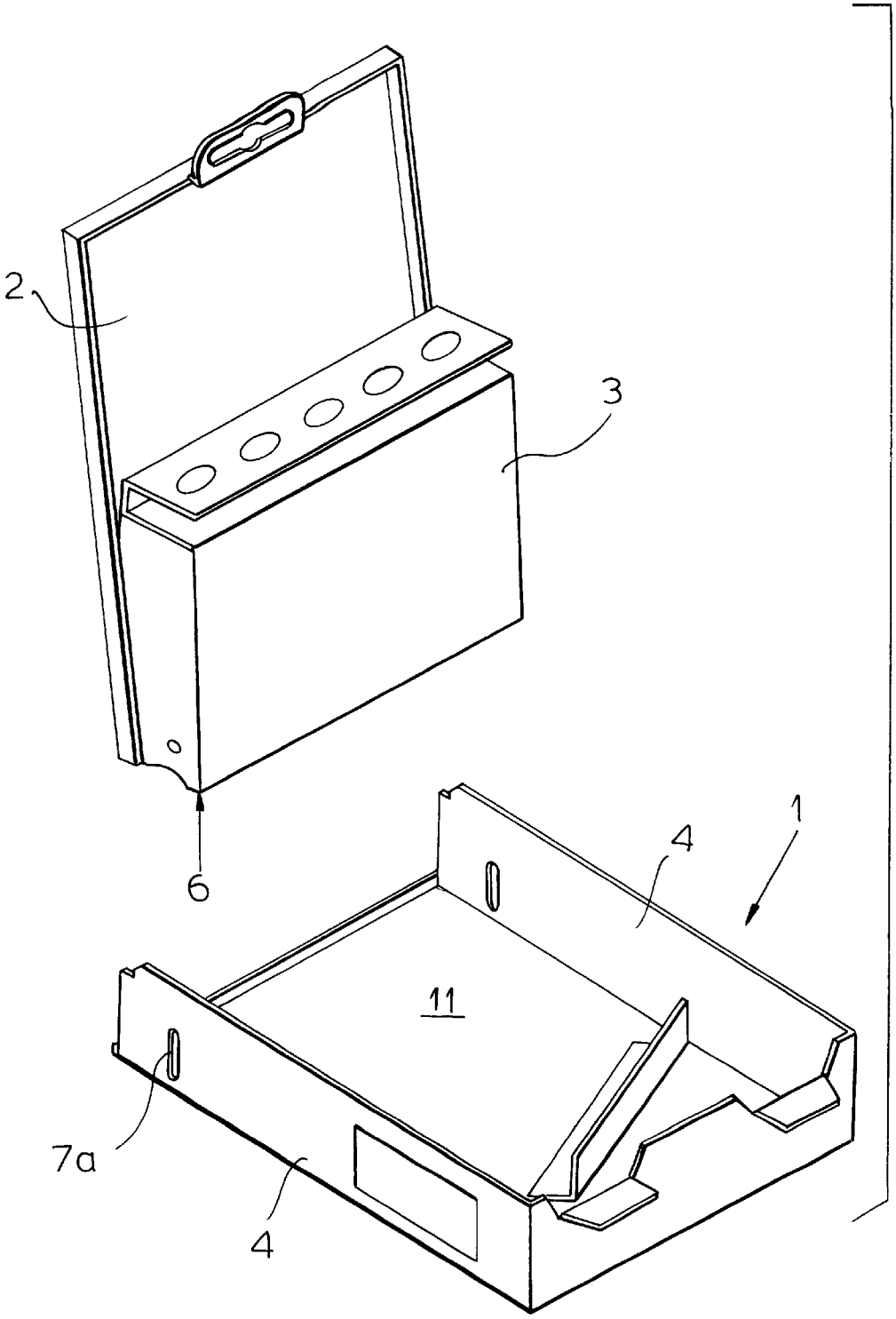
Figure 3:
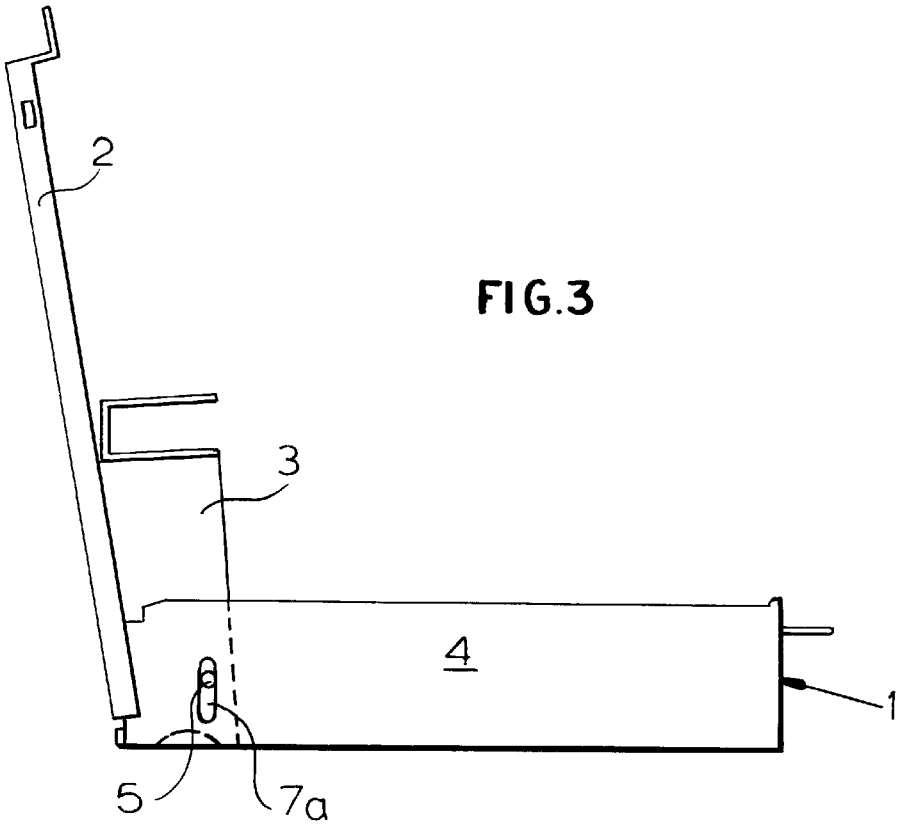
FIGS. 3 and 4 are side views of the boxes shown in respective FIGS. 2 and 1 in open position.
Figure 5:
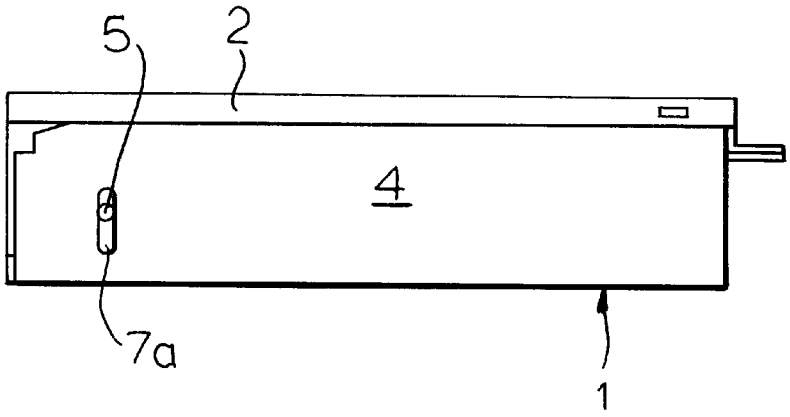
FIG. 5 is a side view of the box of FIG. 3 in closed position.

In the embodiment of FIGS. 2, 3, and 5 the axle 5 is seated at its ends in slots 7*a* that are formed in the side walls 4 and the pin 5 is snugly fitted in small round holes in the holder 3. The effect here is the same, with the holder 3 and cover 2 being pushed up away from the floor 11 as they move between their open and closed positions.

Figure 6:
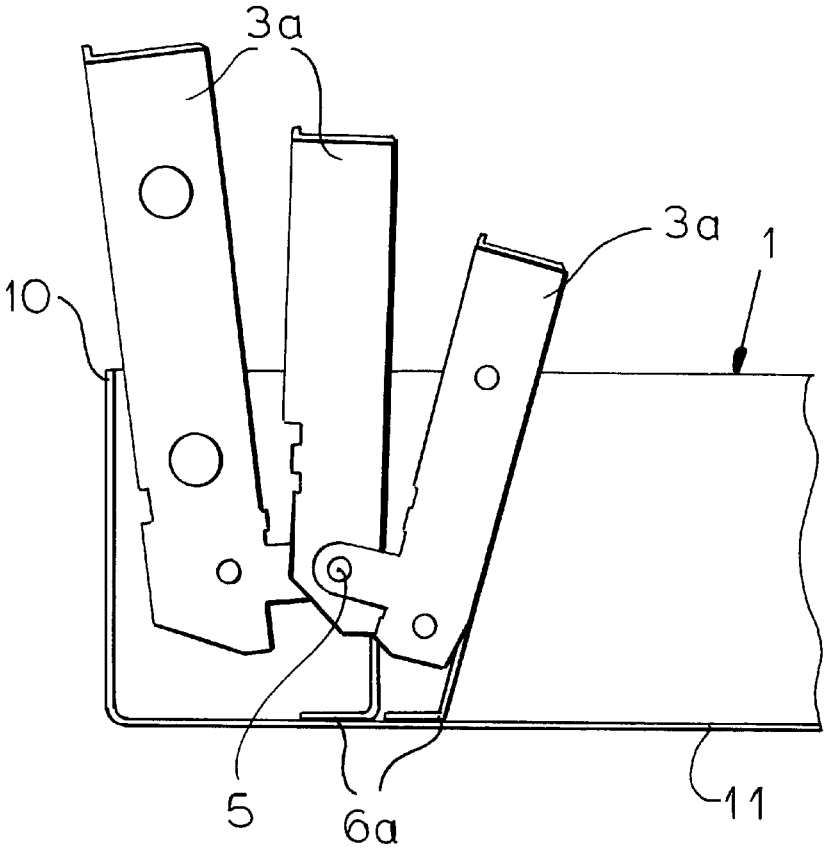
FIGS. 6 and 7 are vertical sections through a third embodiment of the invention in the open and closed positions, respectively.
Figure 7:
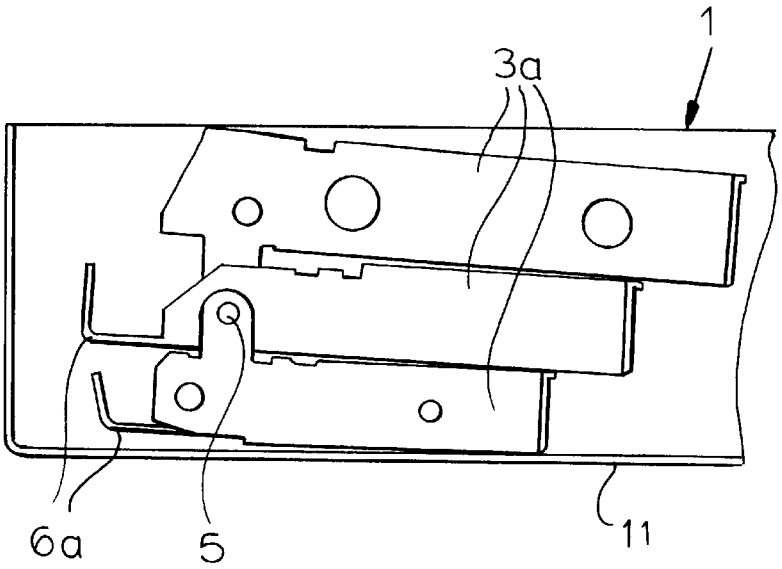

FIGS. 6 and 7 show an arrangement where there are three holders 3*a* carried on the pivot pin 5 and linked together for joint pivoting as is standard in the art. In addition the two front holders 3*a* are formed with L-section cam feet 6*a* that sit flatly on the floor 11 in the raised position of FIG. 6. On pivoting between the FIG. 6 open position and the FIG. 7 closed position, the cam feet 6*a* cam up the holders 3*a* so the pin 5 moves up in the slots 7*a* as in FIGS. 2, 3, and 5.

Figure 8:
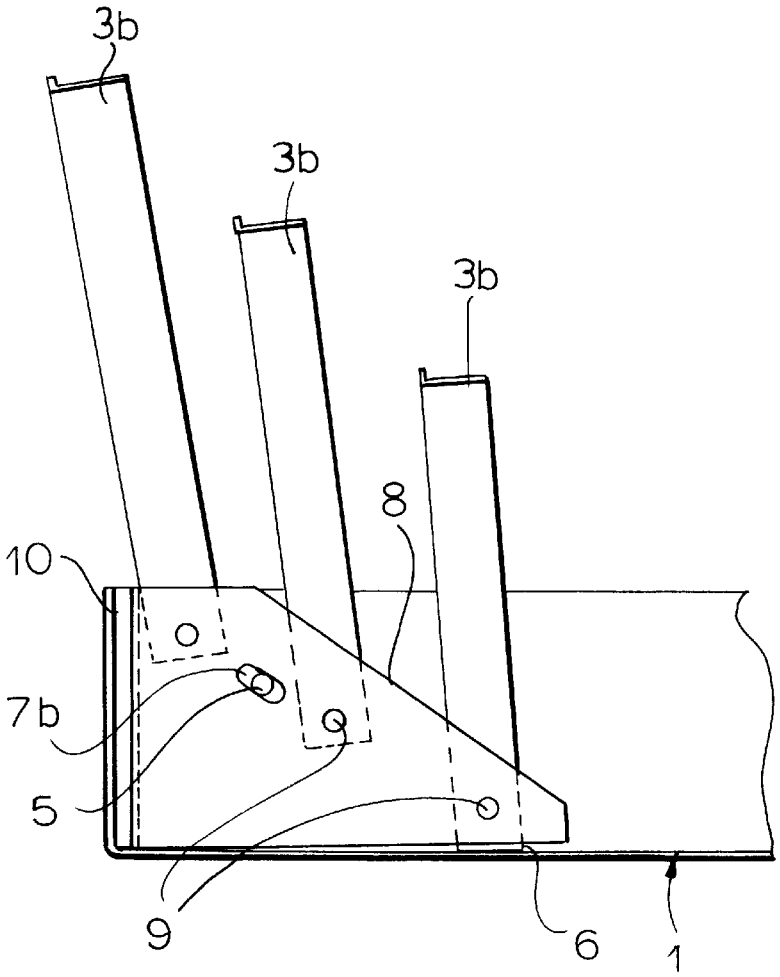
FIGS. 8 and 9 are vertical sections through a fourth embodiment of the invention in the open and closed positions, respectively.
Figure 9:
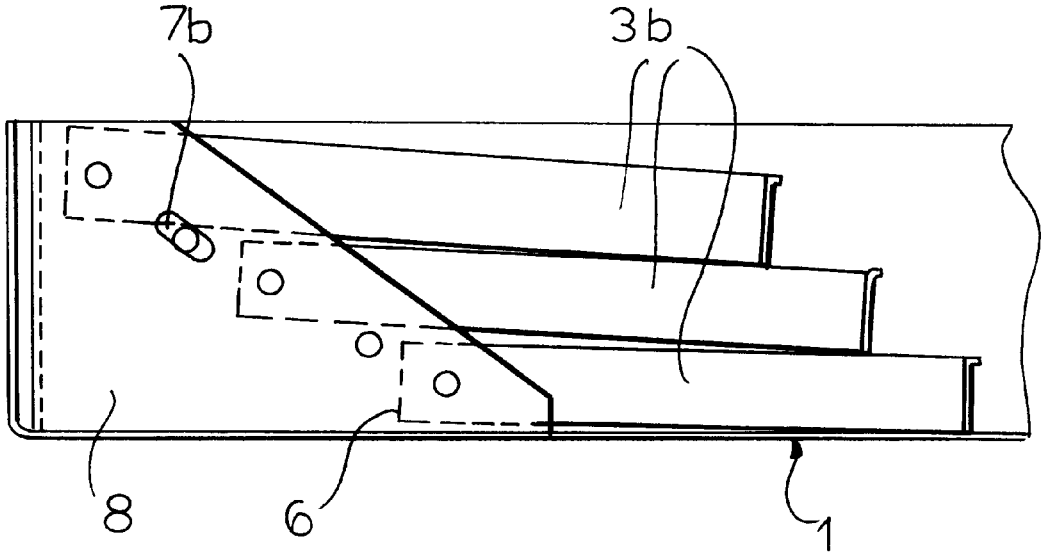

In FIGS. 8 and 9 three inserts 3*b* are pivoted on a common U-shaped holder plate 8 having a back parallel to a back or end wall 10 of the base 1 and a pair of legs parallel to the side walls 4. The inserts 3*b* are coupled together by unillustrated means and are pivoted in the legs of the plate 8 on respective journal pins 9. The axle 5 is fixed in the side walls 4 and rides in notches 7*b* cut in the legs of the plate 8. The rear end of the frontmost insert 3*b* is formed as a cam 6 that projects past the lower edge of the plate 8 so that as the inserts 3*b* are pivoted up, this cam 6 raises the entire holder assembly 3*b*, 8, 9. Once the open position is reached the inserts 3*b* settle back down into place.

Figure 10:
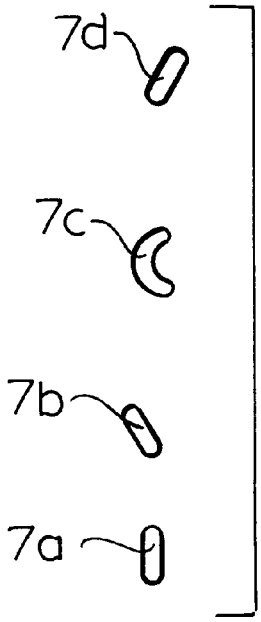
FIG. 10 shows various shapes for the guide of the box according to the invention.

FIG. 10 shows various formations for the slots. The slot 7*a* of FIGS. 2, 3, and 5, and the slot 7*b* of FIGS. 8 and 9 is also shown. A C-shaped slot 7*c* is possible as well as a slot 7*c* inclined at an acute angle to the floor 11 opposite to the slot 7*b*.

I claim:

1. A storage/display box for elongated objects, the box comprising:

a hollow base having a pair of parallel and spaced side walls and a horizontal floor extending between the pair of side walls;

a cover pivotal on the base between a closed position closely engaged over the base and an open position standing upward therefrom;

a holder fittable in the box, adapted to hold at least one of the objects, and having a pair of side walls juxtaposed with the respective side walls of the base;

means including a pivot pin seated in one of the pairs of side walls for pivoting of the holder between a down end position wholly received in the base and an up end position projecting upward therefrom and through an intermediate position between the down and up positions, the holder extending generally vertically in the intermediate position;

means including a guide formed in the other pair of side walls, extending transversely of the floor, and receiving the pin for movement of the pin and of the one pair of side walls vertically relative to the other pair of side walls on pivotal movement of the holder between the down and up end positions while substantially preventing horizontal movement of the pin relative to the one pair of side walls; and means including a cam on the holder engageable with the floor for displacing the holder upward and away from the floor on movement from either of the end positions into the intermediate position and for displacement of the holder downward and toward the floor on movement from the intermediate position into either of the end positions.

2. The storage/display box defined in claim 1 wherein the guide is formed in the side walls of the base.

3. The storage/display box defined in claim 1 wherein the guide is formed in the side walls of the holder.

4. The storage/display box defined in claim 1 wherein the guide is a pair of elongated slots.

5. The storage/display box defined in claim 4 wherein the slots extend generally perpendicular to the floor.

6. The storage/display box defined in claim 4 wherein the slots extend at an acute angle to the floor.

7. The storage/display box defined in claim 4 wherein the slots are arcuate.

8. The storage/display box defined in claim 1 wherein the intermediate position is midway between the end positions.

9. The storage/display box defined in claim 1 wherein in the open position with the floor horizontal the holder cam engages the floor and supports the holder on the floor.

10. The storage/display box defined in claim 9 wherein the holder has an end formed with at least one foot defining a plane extending transversely to the guide.

11. The storage/display box defined in claim 1 wherein the holder includes:

a U-shaped holder plate traversed by the pin and having an edge turned toward the floor, and at least one insert pivoted on the insert plate and having an end constituting the cam and projecting in the intermediate position past the edge.

12. The storage/display box defined in claim 11 wherein the U-shaped plate has a pair of legs each formed with a slot constituting the guide.

* * * * *